US005245850A

United States Patent [19]

Kugler

[11] Patent Number: 5,245,850

[45] Date of Patent: Sep. 21, 1993

[54] PROCESS OF PRODUCING AN OUTER JOINT PART

[75] Inventor: Manfred Kugler, Lohmar, Fed. Rep. of Germany

[73] Assignee: GKN Automotive AG, Siegburg, Fed. Rep. of Germany

[21] Appl. No.: 839,385

[22] Filed: Feb. 21, 1992

[30] Foreign Application Priority Data

Feb. 23, 1991 [DE] Fed. Rep. of Germany ..... 4105757

[51] Int. Cl.[5] ..... B21D 51/16

[52] U.S. Cl. ..... 72/348; 72/333

[58] Field of Search ..... 72/327, 333, 334, 335, 72/348, 370

[56] References Cited

U.S. PATENT DOCUMENTS 4,453,395 6/1984 Takeda et al. ..... 72/348
5,160,108 11/1992 Orain ..... 72/370

FOREIGN PATENT DOCUMENTS 2049184 4/1972 Fed. Rep. of Germany ..... 72/348
2527376 5/1976 Fed. Rep. of Germany .
3018187 11/1981 Fed. Rep. of Germany .
60-130435 11/1985 Japan .
16818 1/1988 Japan ..... 72/348

*Primary Examiner*—Lowell A. Larson
*Attorney, Agent, or Firm*—Harness, Dickey & Pierce

[57] ABSTRACT

A process of producing an outer joint part formed in a non-chip forming way from a plate metal member and having circumferentially distributed, outwardly formed ball tracks. In one or several connected process stages, a plate metal bar is formed into a rotary member whose axial end regions are deformed so as to differ in cross-section from a central portion and that in at least one separate process stage, the ball tracks are formed in an axial region between the deformed end regions.

6 Claims, 3 Drawing Sheets

PROCESS OF PRODUCING AN OUTER JOINT PART

BACKGROUND AND DESCRIPTION OF THE INVENTION

The invention relates to a process of producing an outer joint part formed in a non-chip forming way from a plate metal member and having circumferentially distributed, outwardly formed ball tracks.

DE-AS 25 27 376 shows an inner joint part and an outer joint part produced from a tubular member by radially expanding the original cross-section and by radially upsetting the previously expanded tube end. With this method, the ball tracks in the outer joint part, which are produced to extend as far as the open end of the expanded tubular member, are highly susceptible to cracking.

It is an object of the present invention to produce a process of forming an outer joint part so as to increase the strength of the joint. It is a further object of the invention to reduce the risk of crack formation in the region of the longitudinally extending ball tracks.

According to a first embodiment of the process the objective is achieved by using one or several connected process stages wherein a plate metal bar is formed into a rotary member whose axial end regions are formed so as to differ in cross section from a central portion. In at least one separate process stage the ball tracks are formed in an axial region between the deformed end regions.

In an alternative embodiment, the process comprises in at least one or several connected process stages, a tube is formed into a rotary member whose axial end regions are formed so as to differ from a central portion and in at least one separate process stage, the ball tracks are formed in an axial region between the deformed end regions.

An essential and common feature of the teaching in accordance with the invention consists in the fact that, initially, at both axial ends, forming and/or deforming processes lead to a strengthened region, with the axial tracks subsequently being formed between these strengthened rotationally symmetrical regions. In a preferred embodiment, one of the two ends of the outer joint part is conically tapered and the other one conically expanded, the latter being suitable for comprising an intermediate cylindrical portion which is positioned between two conical portions and to which a convoluted boot may be attached for example.

In order to avoid any kind of crack formation in the material while forming the ball tracks it is advantageous to ensure that in each case, at least one end of the formed ball tracks run into one of the conically deformed end regions. The forming operation preferably includes a conical reduction operation at the one axial end relative to the central portion, especially at the end which is followed by a shaft journal, and that the forming process includes at least one conical expansion stage at the other end relative to the especially cylindrical central portion, i.e. at the opposite open end.

The first embodiment corresponds to a process involving a deep drawing operation in at least one first die involving or utilizing a bar. The second alternative corresponds to a forming operation in a die, involving a rotary member, such as a cylindrical tubular member. An upsetting operation can take place at one end and an expanding operation take place at the other end. A later process stage may take place in a further die where the forming operation according to both alternatives may be the same for forming the ball tracks. The means for the second process stage of forming the ball tracks may preferably comprise a punch consisting of a base member with axial bores partially cutting into the base member and of cylindrical pins with rounded edges positioned therein.

Further details may be identified from the enclosed drawings.

DETAILED DESCRIPTION OF THE PREFERRED EMBODIMENTS

Figure 1:
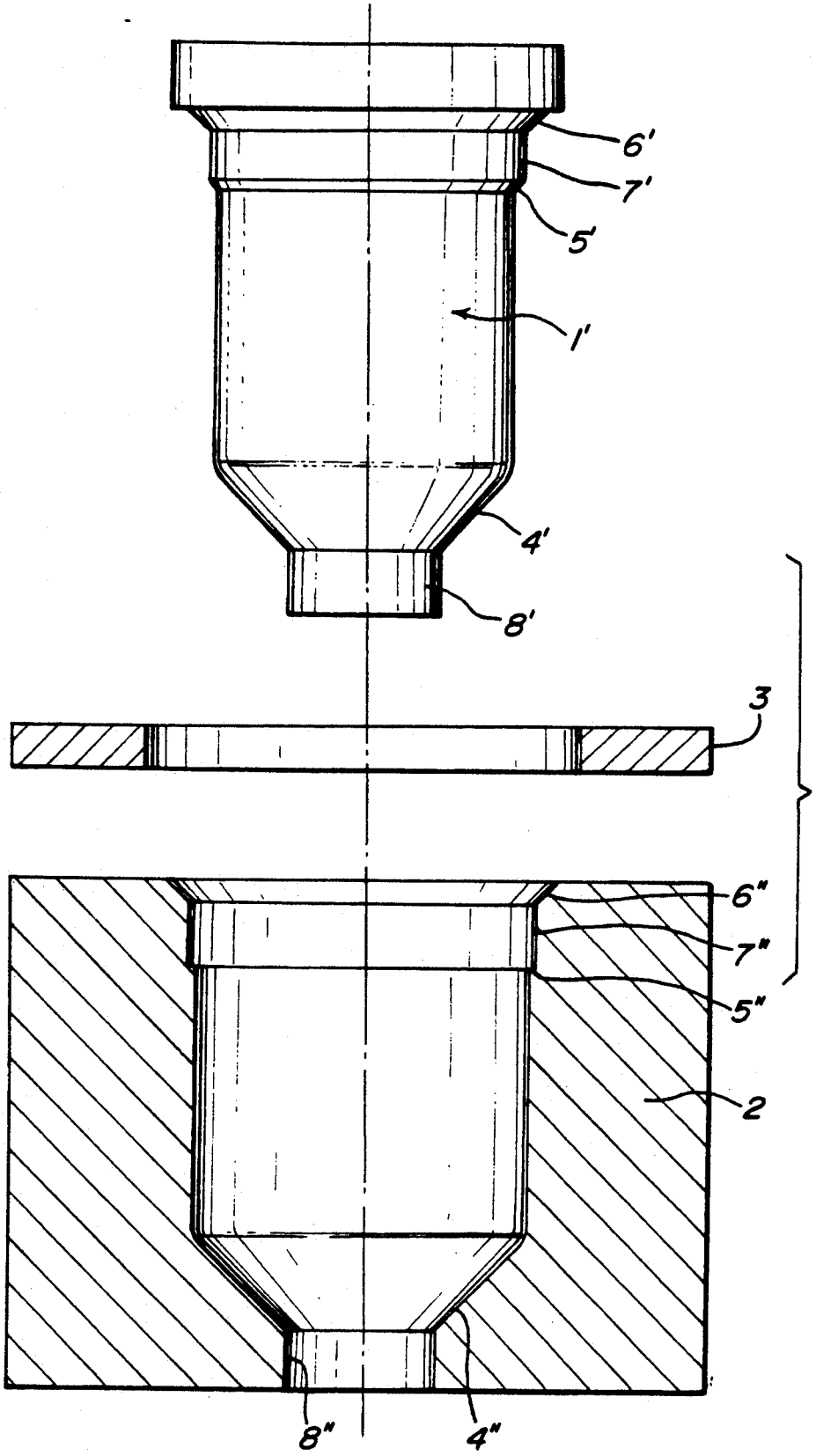
FIG. 1 shows an axial section of a device with punch, holding-down device and die for the first process stage.

FIG. 1 shows a rotationally symmetrical punch 1, a corresponding die 2 and a hold-down device 3 which, for the purpose of holding a bar on the die, may be pushed downwards. The punch comprises a lower conical portion 4', corresponding to a conical portion 4'' in the die. At its rear end, the punch comprises a first conical portion 5', a second conical portion 6' and an intermediate cylindrical portion 7,, with corresponding parts, i.e. a cross-sectional step 5'', an inner cone 6'' and a cylindrical portion 7'' being provided in the die. When the punch 1 is lowered into the die 2, the shape of the bar or metal stock (not illustrated) is substantially formed to that of the punch. A journal-type projection 8' at the base of the punch, which form-fittingly engages an inner aperture 8'' in the die, punches out the central portion of the bar.

Figure 2:
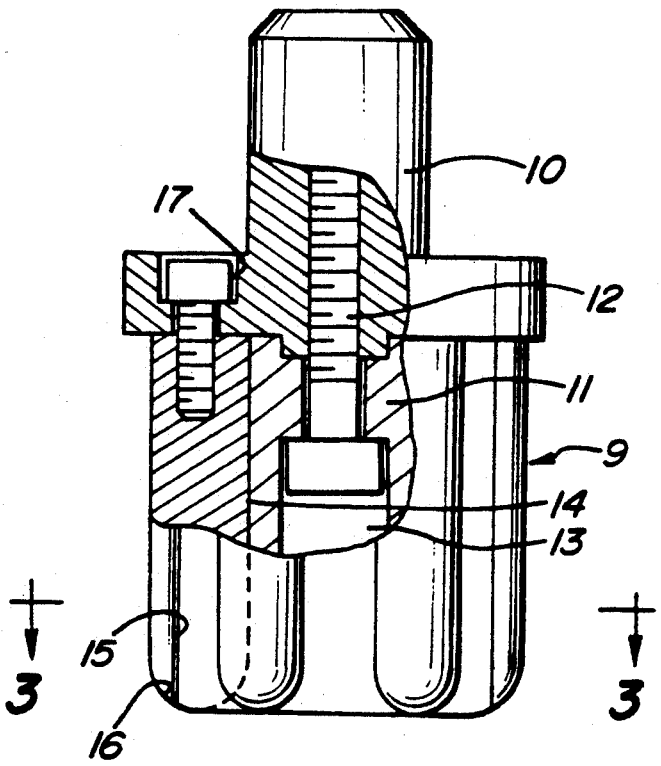
FIG. 2 is a partial axial section of a punch for the second process stage.
Figure 3:
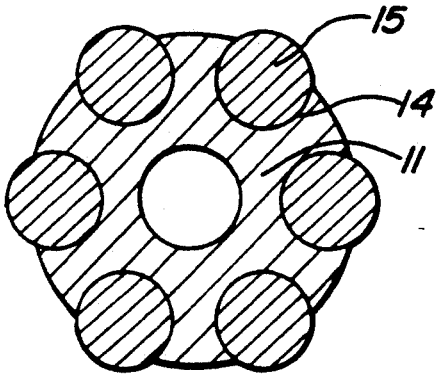
FIG. 3 is a cross-section of a punch for the second process stage.

FIGS. 2 and 3 show a second punch 9 composed of a substantially disc-shaped upper part 10 and a substantially cylindrical lower part 11 which are connected by a bolt 12. The cylindrical lower part is provided with a central bore 13 for the bolt 12 and with circumferentially distributed bores 14 which cut into the cylindrical lower part 11. The bores 14 contain journals 15 with rounded points 16, which journals 15 are secured by bolts 17 passing through the upper part 10. These serve to form the ball tracks in the outer joint part.

Figure 4:
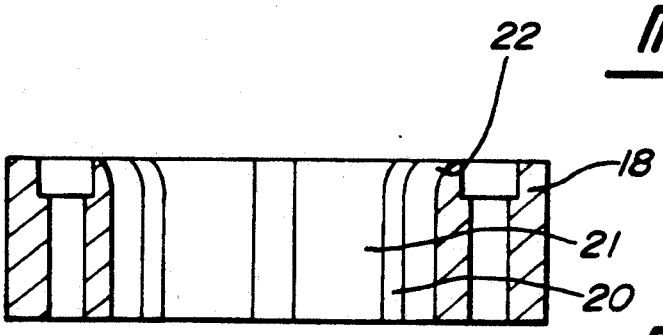
FIG. 4 is an axial section of a die for the second process stage.
Figure 5:
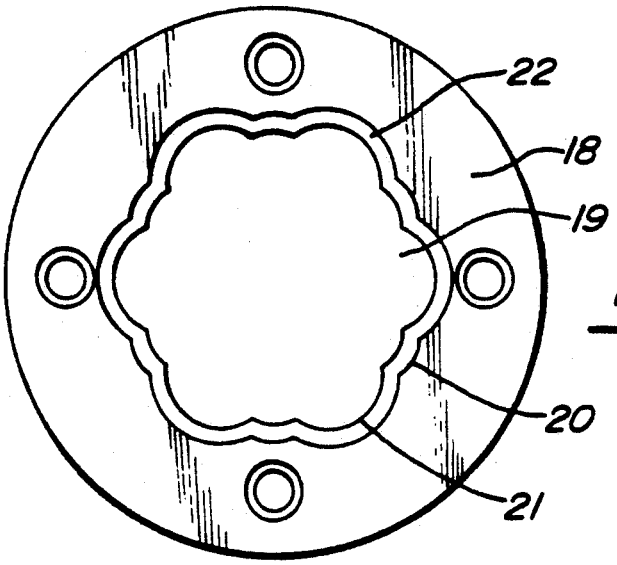
FIG. 5 is a plan view of a die for the second process stage.

FIGS. 4 and 5 show a die 18 whose inner aperture 19, when viewed in cross-section (FIG. 4), consists of a cylindrical base member 20 and ball track portions 2I formed therein. The internal cross-section corresponds to the cross-section of the punch 9 having a cylindrical basic member 11 and cylindrical journals 15 projecting therefrom. At its upper end, the die is provided with a continuous, uniformly expanded cross-sectional portion 22.

Figure 6:
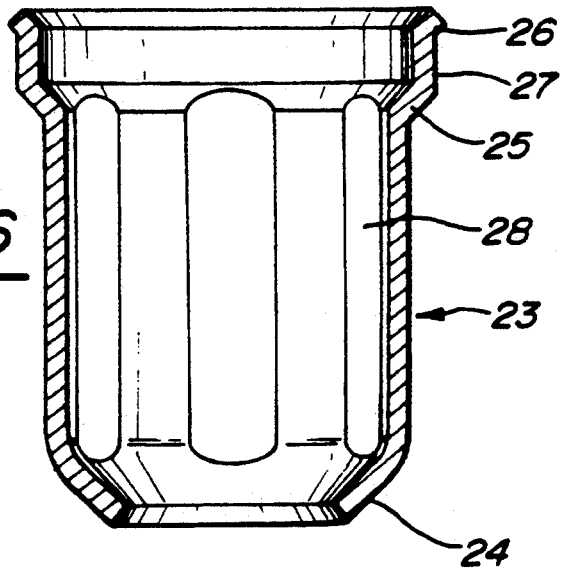
FIG. 6 is an axial section of a product produced by a process in accordance with the invention.
Figure 7:
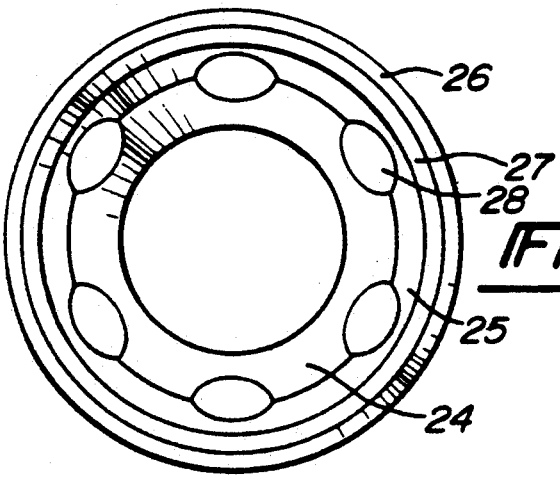
FIG. 7 a plan view of a product produced by a process in accordance with the invention.

FIGS. 6 and 7 show an outer joint part 23 produced by the process of the invention having a lower conical upset portion 24, two upper conically expanded or flared portions 25, 26 and an intermediate cylindrical portion 27, with ball tracks 28 being formed so as to extend only partially into the conical portions 24 and 25.

What is claimed is:

1. A process of producing an outer joint part in a non-chip forming manner comprising:

providing plate metal stock;

forming said metal stock into a generally cylindrical member with a central portion having first and second ends, having a first diameter;

forming first axial end region having a second diameter at said first end of said central portion, said first diameter not being equal to said second diameter;

forming second axial end region having a third diameter at said second end of said central portion, said first diameter not being equal to said third diameter wherein first said axial end region forming step further comprises conically expanding said metal stock and said second axial end region forming step further comprises conically reducing said metal stock;

forming, in a step not coincidental with all of the above steps, circumferentially distributed outwardly formed ball tracks within said central region; and wherein said ball tracks are formed so as to extend into at least one axial end region.

2. The process of claim 1 wherein said axial end forming steps take place in a separate die from said cylindrical member forming step.

3. A process of forming an outer joint part formed in a non-chip forming way from a plate metal member comprising:

forming a tube into a rotary member having a central portion;

deforming the axial end regions of said tube to different diameters than said central portion wherein one of said axial end region forming steps comprises a conical reduction operation relative to said central portion, wherein one of said axial end region forming steps comprises a conical expansion operation relative to said central portion;

in a separate process step from said rotary member forming step and said deforming step, forming between said deformed end regions circumferentially distributed outwardly formed ball tracks having first and second ends; and wherein at least one end of each of said ball tracks terminates in at least one of said deformed end regions.

4. The process of claim 3 wherein said forming the rotary member step takes place in a first die and said deforming step takes place in a second die.

5. The process of claim 4 wherein said first axial end region forming step further comprises:

forming a first flared portion;

forming a second flared portion; and forming a generally cylindrical portion intermediate said first and second flared portions.

6. The process of claim 3 wherein said deforming step further comprises:

forming a first flared portion at first said axial end region;

forming a second flared portion at second said axial end region; and forming a generally cylindrical portion intermediate said first and second flared portions.

* * * * *